US010348033B2

(12) United States Patent
Stucchi

(10) Patent No.: US 10,348,033 B2
(45) Date of Patent: Jul. 9, 2019

(54) LINEAR CONNECTION ASSEMBLY FOR ELECTRICAL CONDUCTORS WITH HIGH LOCKING RELIABILITY

(71) Applicant: A.A.G. STUCCHI S.r.l., Olginate (IT)

(72) Inventor: Aristide Stucchi, Lecco (IT)

(73) Assignee: A.A.G STUCCHI S.R.L., Olginate (LC) (IT)

( * ) Notice: Subject to any disclaimer, the term of this patent is extended or adjusted under 35 U.S.C. 154(b) by 0 days.

(21) Appl. No.: 15/808,501

(22) Filed: Nov. 9, 2017

(65) Prior Publication Data

US 2018/0131130 A1 May 10, 2018

(30) Foreign Application Priority Data

Nov. 10, 2016 (IT) ..... 102016000113670

(51) Int. Cl.

| | |
|---|---|
| ***H01R 24/86*** | (2011.01) |
| ***H01R 13/625*** | (2006.01) |
| ***H01R 13/629*** | (2006.01) |
| ***H01R 13/639*** | (2006.01) |
| ***H01R 13/642*** | (2006.01) |

(Continued)

(52) U.S. Cl.

CPC ..... *H01R 13/625* (2013.01); *H01R 13/5202* (2013.01); *H01R 13/629* (2013.01); *H01R 13/639* (2013.01); *H01R 13/642* (2013.01); *H01R 24/86* (2013.01); *H01R 2107/00* (2013.01)

(58) Field of Classification Search

CPC ..... H01R 13/5202; H01R 13/625; H01R 13/629; H01R 13/639; H01R 13/642; H01R 24/86

See application file for complete search history.

(56) References Cited

U.S. PATENT DOCUMENTS 3,805,379 A * 4/1974 Vetter ..... H01R 13/623 29/881

4,140,358 A * 2/1979 Marechal ..... H01R 13/447 439/139

(Continued)

*Primary Examiner* — Edwin A. Leon

*Assistant Examiner* — Oscar C Jimenez

(74) *Attorney, Agent, or Firm* — Florek & Endres PLLC

(57) ABSTRACT

The present invention relates to a linear connection assembly (100) for electrical conductors comprising a pair of connectors (1, 2) with mutually complementary shape for the insertion of a first connector (1) into a second connector (2) in an axial direction; each connector (1, 2) being provided with electrical contacts (5, 6) adapted to connect electrically to each other when the first connector (1) is inserted in the second connector (2), at least one connector (2) of the pair of connectors (1, 2) being provided with a ring nut (4) mounted in at least partially rotatable manner manually around its own axis (A) parallel to said axial direction to reach a plurality of alignment positions relative to the other connector (1) of the pair of connectors (1, 2), each alignment position corresponding to a connection condition between the pair of connectors (1, 2); t a first alignment position (17) results from a complete insertion of said first connector (1) into said second connector (2), and corresponds to a first connection condition according to which said connectors (1, 2) cannot be released even if a mutual traction is applied in the axial direction.

12 Claims, 4 Drawing Sheets

(51) Int. Cl.
*H01R 13/52* (2006.01)
*H01R 107/00* (2006.01)

(56) References Cited

U.S. PATENT DOCUMENTS

| | | | | | |
|---|---|---|---|---|---|
| 4,478,473 | A * | 10/1984 | Frear | H01R 13/622 | 439/312 |
| 4,902,238 | A * | 2/1990 | Iacobucci | H01R 13/447 | 439/135 |
| 5,641,310 | A * | 6/1997 | Tiberio, Jr. | H01R 13/625 | 439/680 |
| 7,077,677 | B2 * | 7/2006 | Sanuki | H01R 13/623 | 439/315 |
| 7,837,491 | B2 * | 11/2010 | Collin | H01R 13/62966 | 439/317 |
| 7,988,479 | B2 * | 8/2011 | Hankins | H01R 13/625 | 439/314 |
| 9,407,041 | B2 * | 8/2016 | Lirong | H01R 43/26 | |
| 9,705,248 | B1 * | 7/2017 | Ko | H01R 13/6275 | |
| 9,810,858 | B2 * | 11/2017 | Gniadek | G02B 6/3894 | |
| 2014/0302724 | A1 * | 10/2014 | Ono | H01R 13/4364 | 439/751 |
| 2015/0180167 | A1 * | 6/2015 | Haas | H01R 13/64 | 439/311 |
| 2018/0034212 | A1 * | 2/2018 | Quero | H01R 13/521 | |

* cited by examiner

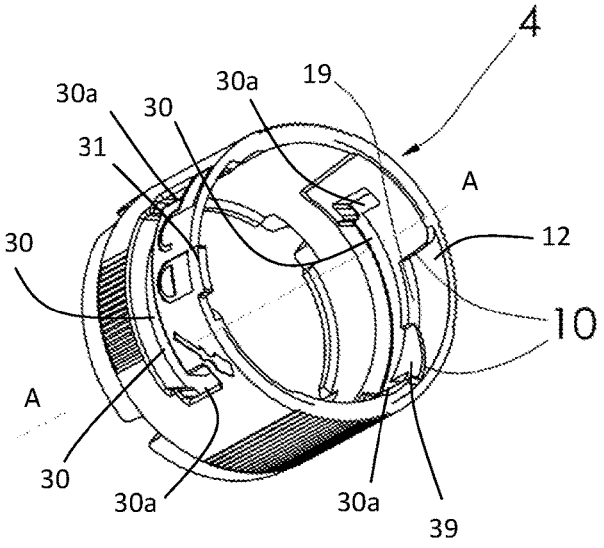
FIG. 3a
FIG. 3b
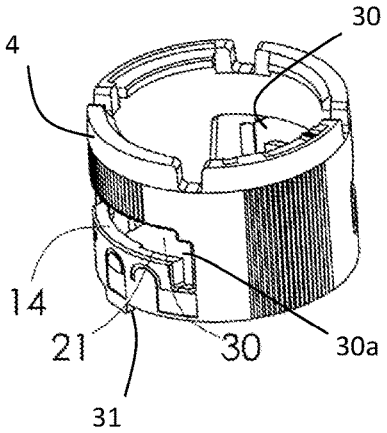
FIG. 4
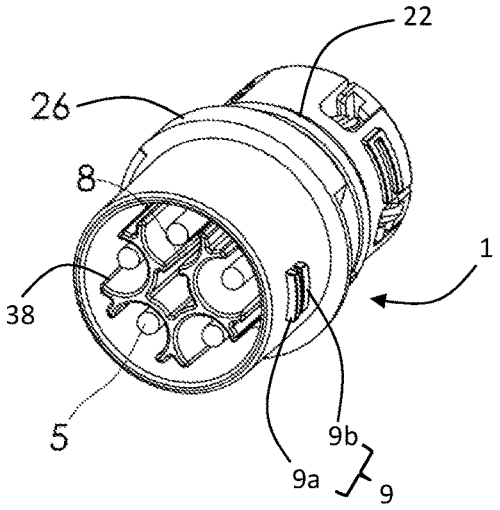

LINEAR CONNECTION ASSEMBLY FOR ELECTRICAL CONDUCTORS WITH HIGH LOCKING RELIABILITY

The present invention relates to a linear connection assembly for electrical conductors with high locking reliability. In particular, the present invention relates to end connectors of electrical conductors of the socket-plug type.

Within the field of electrical wiring, use of connection assemblies is known, for example those of the socket-plug type, whose purpose is to allow the connection between the ends of different electrical conductors. These assemblies comprise a first socket connector and a second plug connector, shaped complementarily to the socket connector for the purpose of being inserted therein and thereby to establish the connection between the conductors.

On the market, the most widely used solutions comprise up to three ways, thus being adapted to connect phase, ground and neutral conductors. However, solutions are also known that allow the connection of more than three conductors, used to manage not only power supply electrical signals but also control electrical signals, for example to drive different devices within the same apparatus.

The complementary shape between plug connector and socket connector is such as to assure a very precise relative positioning between the two connectors in order to assure the connection between corresponding conductors.

Moreover, some known connection assemblies have watertight connectors to enable their use in humid environment or temporary immersion in a liquid. This result is commonly obtained through the use of gaskets with planar support or of the O-ring type which operate radially, to be positioned between coupled parts in order to create a barrier that prevents dusts and/or liquids from penetrating inside the protecting guards of the conductors.

With reference to known solutions, the Applicant has observed that the use of planar support or O-ring gaskets entails several drawbacks, including the risk of an erroneous positioning of the gaskets, of forgetting the positioning of the gaskets, of loss of the gaskets during wiring operations and so on. In these cases, the water tightness is made ineffective.

In addition, linear connection assemblies for electrical conductors are required to provide a mechanical locking between the two connectors of the assembly in order to prevent an accidental disconnection. In particular, the reference standards for linear connection assemblies for electrical conductors require, on one hand, that plug and socket connectors are provided with an immediate retaining mechanism that triggers with the simple insertion of the plug connector into the socket connector, and on the other hand, that the disconnection operation has to take place with an intentional act by the operator, for example modifying the position of an element on at least one of the two connectors.

A solution that implements these specifications is described in patent application EP2882049. This document describes a linear connection assembly for electrical conductors in which the plug connector is provided with an external rotatable ring. On the inner wall of the rotatable ring are obtained three noses intended to engage in corresponding recesses obtained on the outer wall of the socket connector. In particular, with the insertion of the plug connector into the socket connector, the noses reach a first recess into which they are engaged determining a condition of first locking. EP 2882049 describes that the first recess determines a scarcely protruding abutment, i.e. such that it can be overcome by the application of a manual traction/thrust force along the axis of the plug-socket pair.

By turning the ring according to a direction orthogonal to the axis, it is possible to make the noses overcome a wall, bringing them to a deeper recess. In this condition of stable locking, the abutment determined by the wall of the recess cannot be overcome by the noses. To make the disconnection, it is first necessary to bring back the noses beyond the wall, which operation can only be carried out using a tool.

The Applicant has observed that known connection assemblies, in addition to being complex from a constructive viewpoint, do not offer a high degree of reliability in preventing accidental disconnections when they are in the condition of first locking, i.e. as a result of a purely axial connection action as required by the standards. In accordance with the description of EP 2882049, in the first locking condition it is sufficient to apply manually an axial traction force to obtain the detachment between the plug connector and the socket connector. This is allowed thanks to the abutment against which the noses are engaged at the first recess reached upon inserting the plug connector into the socket connector, which purposely achieves a scarcely protruding abutment.

The Applicant has also observed that, by contrast, in known connecting assemblies, once the stable locking condition is reached, the user is forced to act with a tool through a hole, without having visual access to the area in which the tool has to operate in order to bring the connecting assembly back to a condition in which the release is allowed. This operation therefore requires a certain dexterity and experience to be completed successfully in reasonable times.

The Applicant has thus perceived the requirement to provide a linear connection assembly for electrical conductors that, on one hand, would prevent a disconnection as a result of the application of a manual traction force even in the first locking condition, and on the other hand however, once the stable locking condition is reached, would enable to restore a locking condition that can be released easily and quickly.

The patent document published with the number WO 2012/141337 A1 describes and illustrates a connecting assembly according to which a first connector is adapted to be inserted in an axial direction into a second connector (once the insertion is completed, there is no electrical connection between the electrical contacts of the two connectors); after this manual operation, the connectors are released if a mutual traction is applied between the two connectors in the axial direction; only after a mutual rotation of the two connectors, the release is prevented and the electrical connection is obtained.

The patent document published with the number U.S. Pat. No. 5,641,310 A describes and illustrates a connecting assembly according to which a first connector is adapted to be inserted in an axial direction into a second connector (once the insertion is completed, there is no electrical connection between the electrical contacts of the two connectors); after this manual operation, the connectors are released if a mutual traction is applied between the two connectors in the axial direction; only after a mutual rotation of the two connectors, the release is prevented and the electrical connection is obtained.

In light of the above, the problem at the basis of the present invention is that of devising a linear connection assembly for electrical conductors with high locking reliability already in the first locking condition.

Within the scope of this problem, an object of the present invention is to provide a linear connection assembly for electrical conductors that is easy to use both in the connection phase, and in the detachment phase between the two connectors of the assembly.

Not the least object of the present invention is to study a linear connection assembly for electrical conductors that is simple to build and obtainable at low costs.

In accordance with a first aspect, the invention thus relates to a linear connection assembly for electrical conductors comprising a pair of connectors with mutually complementary shape for the insertion of a first connector into a second connector in an axial direction; each connector is provided with electrical contacts adapted to connect electrically to each other when the first connector is inserted in the second connector; at least one connector of the pair of connectors is provided with a ring nut mounted in at least partially rotatable manner manually around its own axis parallel to the axial direction to reach a plurality of alignment positions relative to the other connector of the pair of connectors; each alignment position corresponds to a connection condition between the pair of connectors; a first alignment position results from a complete insertion of the first connector into the second connector, and corresponds to a first connection condition according to which the connectors cannot be released even if a mutual traction is applied in the axial direction.

Preferably, a second alignment position results from a manual rotation of the ring nut in a first direction starting from the first alignment position, and corresponds to a second connection condition according to which the connectors are released if a mutual traction is applied in the axial direction.

Preferably, a third alignment position results from a manual rotation of the ring nut in a second direction starting from the first alignment position, and corresponds to a third connection condition according to which the connectors cannot be released even if a mutual traction is applied in the axial direction; a manual rotation of the ring nut from the third alignment position to the first alignment position is possible only if combined to an action of a tool on the ring nut and/or on a connector of the pair of connectors.

The connectors and/or the ring nut have appropriate combination and configuration of parts such as to achieve the first connection condition and/or the second connection condition and/or the third connection condition.

The present invention can have at least one of the preferred features that follow, which can in particular be mutually combined at will, to meet specific application requirements.

Preferably, a connector of the pair of connectors is provided with the ring nut and the other connector of the pair of connectors comprises at least one tooth projecting from the body of the connector in a radial direction; the tooth is adapted to co-operate with a fin projecting from the ring nut in an axial direction to block the rotation of the ring nut in at least one direction of rotation.

The Applicant has determined that thanks to the presence of a fin projecting axially from the ring nut which co-operates with a tooth projecting radially from the body of the connector whereon the ring nut is not mounted it is possible to block the rotation of the ring nut and hence reliably to prevent the ring nut from reaching the condition in which the connection between the two connectors can be released by a simple manual traction. Thus, the locking reliability is increased.

This feature further makes it possible to have an easy access to the mutual binding point with an appropriate instrument. Thus, it is simple and quick to bring the ring nut back to a condition in which it is free to rotate to reach the positioning in which the connection between the two connectors can be released by manual traction.

The present invention can have at least one of the preferred features that follow, which can in particular be mutually combined at will, to meet specific application requirements.

Preferably, the tooth is provided within a recess obtained on the body of the other connector at an abutment portion for the ring nut when the first connector is inserted in the second connector.

Advantageously, in this way it is possible to achieve the fastening of the fin and the tooth in the absence of elements projecting from the outer surface of the connector. The tooth is housed in the recess and it co-operates with the fin that also moves within the recess.

Preferably, the coupling tooth comprises, on one side, a side wall projecting from the body of the other connector in an inclined manner to facilitate the passage of the axial fin according to a first angular direction and, on the other side, a wall projecting orthogonally from the body of the other connector to block the passage of the axial fin according to an angular direction opposite the first.

Advantageously, by the particular construction of the coupling tooth the rotation of the ring nut is freely allowed only in one direction of rotation. In this way, it is possible to manually bring the ring nut to the locked condition, while to return to the release condition it is necessary to use a tool. This provides a high degree of locking reliability, while maintaining the ease of bringing the ring nut to the locked condition.

More preferably, the recess obtained on the body of the other connector comprises a recess portion adapted to allow the insertion of a tool beneath the axial fin when the axial fin is in the condition in which the coupling tooth blocks its rotation according to the angular direction opposite the first.

This advantageous feature makes it possible to reach the binding point in order to operate the unlocking of the ring nut easily and quickly.

Preferably, the other connector of the pair of connectors comprises at least one protrusion adapted to cooperate with a respective entrance guide made in the inner wall of the ring nut to reach an opening that develops orthogonally to the axis, also made in the inner wall of the ring nut, the opening being delimited on a side orthogonal to the axis by a contact wall adapted, at a first section, to determine a stop abutment for the at least one protrusion.

Advantageously, this solution makes it possible to already obtain a first stable block against manual traction by the simple insertion of one connector in the other. The contact wall determines a sufficiently projecting stop to lock the protrusion in position against a traction force applied along the axis.

More preferably, the contact wall that delimits the orthogonal opening comprises a second section defining an axial passage for the at least one protrusion when releasing the connectors.

Advantageously, the second section of the contact wall defines a passage for the protrusion, not preventing the passage of the protrusion and thus allowing the release of the connection between the two connectors by simple manual traction along the axis.

More preferably, the other connector of the pair of connectors comprises a pair of protrusions comprising a first guide protrusion and a second coupling protrusion, the guide protrusion being more prominent than the coupling protrusion to cooperate in abutment against a respective entrance guide obtained in the inner wall of the ring nut and the coupling protrusion being adapted to cooperate in abutment against the first section of the contact wall.

More preferably, the opening obtained in the inner wall of the ring nut is of the through type.

Advantageously, the through opening makes it possible to visualise the relative positioning of the protrusion inside the opening and, accordingly, to understand at sight the locked condition of the two connectors.

Still more preferably, the through opening has at least an axial notch at the lateral ends.

Still more preferably, the entrance guide is obtained a first recess in the inner wall of the ring nut that extends substantially between a free end of the ring nut and the respective opening.

Of further preference, at the respective opening, the first recess joins the contact wall by means of an inclined joining surface, where preferably the guiding protrusion is adapted to co-operate in support against the connecting surface to determine a temporary elastic deformation of at least one portion of the ring nut.

Advantageously, the guiding protrusion, thrusting against the connecting wall of the entrance guide obtained in the inner part of the ring nut, determines a temporary elastic deformation of the ring nut, in particular, of the portion of ring nut delimited by the through opening and by the axial notches. The notches facilitate the elastic deformation of this portion of the ring nut. In this way, the coupling protrusion is allowed to pass beyond the connecting surface and to be positioned abutting against the contact wall of the opening. Otherwise, the difference in elevation between the entrance guide and the projection of the contact wall would not allow the coupling protrusion to overcome the connecting surface to be positioned beyond the contact wall.

Preferably, on the outer surface of the ring nut is obtained at least one symbol and on the body of the other connector is obtained a second symbol, the alignment of the at least one symbol with the second symbol indicating a position of mutual alignment between the ring nut and the other connector.

Advantageously, the presence of symbols obtained on the outer surface of the ring nut and on the body of the other connector makes it possible to visualise even more intuitively the relative positioning of the protrusions within the opening and, according thereto, to understand at sight the locked condition between the two connectors.

Preferably, on the body of at least one connector of the pair of connectors is present at least one annular gasket obtained by a moulding operation.

Advantageously, by obtaining the gaskets by overmoulding, the problem of the accidental loss of the gaskets is overcome, while also preventing wrong positioning or missed use as a result of forgetfulness, ensuring that the connection assembly is always watertight.

Obtaining the gaskets by overmoulding entails injecting a second plastic material of thermoplastic elastomeric nature (e.g. TPE, or Thermo-Plastic Elastomer) on a first rigid, structural material (e.g., Nylon) directly in the production phase. The attachment between the two materials is thus chemical, and this feature prevents their separation and makes the product more economical. Overmoulding the gaskets makes it possible not to have to manipulate the connecting assembly at a second time to add the gaskets, to the benefit of the final cost.

Advantageously, the overmoulded gasket is annular, thus positioned on a circular surface, working in radial direction. In this way, compared to solutions with planar gasket, less of an effort is required to obtain water tightness. In addition, positioning on a radial surface makes coupling with the enclosure of the connectors always equal, regardless of the closing force. Thus, the ring nut is not involved in assuring water tightness, being intended solely to assure the connection between the plug connector and the socket connector.

Further features and advantages of the invention will be more evident from the following detailed description of some preferred embodiments thereof, made with reference to the accompanying drawings.

The different features in the individual configurations can be mutually combined at will according to the preceding description, if it should be necessary to exploit the advantages resulting specifically from a particular combination.

In such drawings,

FIG. 1 is a perspective view of a preferred embodiment of a linear connection assembly for electrical conductors according to the present invention;

FIGS. 2*a* and 2*b* are respectively a complete frontal perspective view and a lateral elevation view without ring nut of a socket of the connecting assembly of FIG. 1;

FIGS. 3*a* and 3*b* are perspective views according to different angles of the ring nut used in the socket of the connecting assembly of FIG. 1;

FIG. 4 is a frontal perspective view of a plug of the connecting assembly of FIG. 1;

FIGS. 5*a*-5*c* are partial lateral elevation view of the ring nut of FIGS. 3*a* and 3*b* in three different relative configurations with respect to the outer body of the plug of the connecting assembly of FIG. 1;

In the following description, for the illustration of the figures identical reference numerals or symbols are used to indicate constructive elements with the same function. In addition, for clarity of illustration, some reference may not be repeated in all figures.

Figure 1:
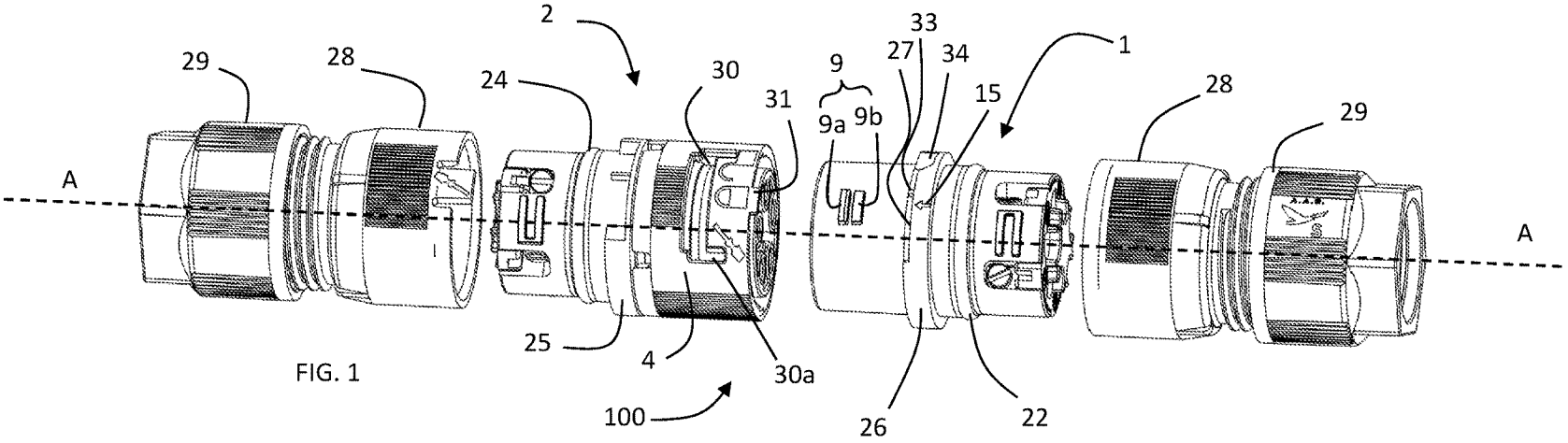

With reference to FIG. 1, a linear connecting assembly for electrical conductors is shown, indicated in its entirety with the numeral 100

Figure 2B:
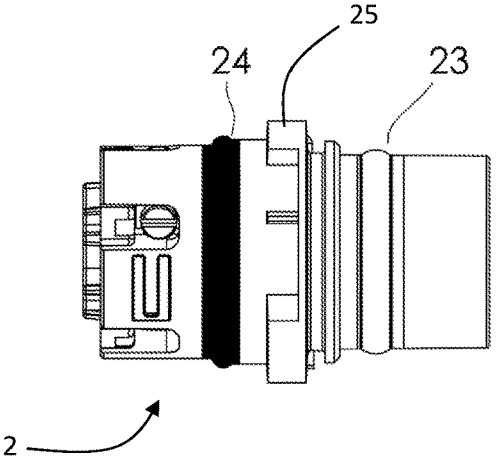
Figure 2A:
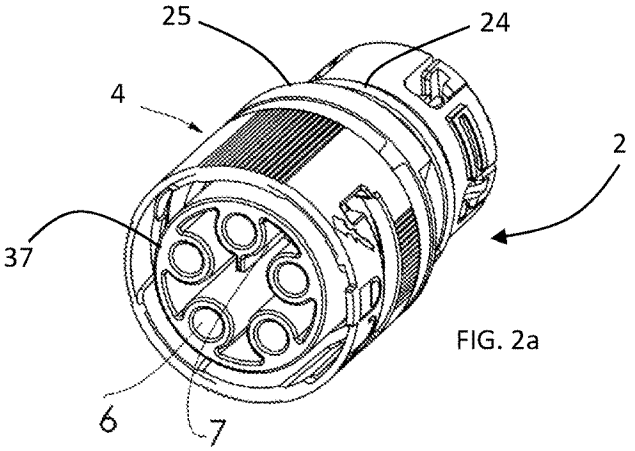

The connecting assembly 100 comprises a plug connector 1 and a socket connector 2 provided with respective electrical contacts 5,6 shown in detail in FIGS. 2*a* and 4.

The plug connector 1 has complementary shape to the socket connector 2 for the purpose of its interpenetration therein 2.

Specifically, the plug connector 1 is provided with a plurality of contact pins 5 arranged correspondingly to a plurality of contact bushings 6 present in the socket connector 2 and each of them is intended to accommodate a contact pin 5 of the plug connector 1.

Moreover, the plug connector 2 internally comprises a female axial guide 37 wherein is inserted a corresponding male axial guide 38 present in the plug connector 1. The female guide 37 is provided with an axial rib 7 projecting towards the interior of the guide 37 that co-operates with a corresponding axial slot 8 present in the male guide 38 of the plug connector 1 and the socket connector 2 according to a univocal mutual orientation, so as to assure the correct interpenetration of the respective polarities of the connection assembly 100.

In the embodiment illustrated by way of example, on the plug connector 2 is amounted a ring nut 4 shown in detail in FIG. 3*a*. The ring nut 4 is made in the shape of a hollow cylinder and it is mounted on the socket connector 2 as shown in FIG. 2*a*.

In particular, the ring nut 4 is mounted on the socket connector 2 in a manner that is at least partially free to rotate around its own axis of symmetry A and abutting against a first annular nose 25 projecting from the body of the socket connector 2. The ring nut 4 is intended to affect a reliable connection between the socket connector 2 and the plug connector 1 once one 1 is inserted in the other 2 and for this reason it can also be called "clamping ring nut".

The ring nut 4 comprises on its jacket surface two through openings 30 that develop orthogonally to the axis A and have, at the respective lateral ends, two notch portions 30*a* which develop parallel to the axis A.

As shown in detail in FIG. 3*a*, on the inner surface of the ring nut 4 are obtained two entrance guides 10, specifically having semi-funnel shape, obtained as a first recess 12 in the inner wall of the ring nut 4. The recess 12 defines a surface that is recessed relative to the surface of the inner wall of the ring nut 4.

Each entrance guide 10 is obtained in an adjacent area to a through opening 30. In particular, each entrance guide 10 starts from the free end of the ring nut 4 which, once it is mounted on the ring nut connector 2, faces the side that is faced by the electrical contacts 6, and terminates in proximity to the respective opening 30.

At the opening 30, the recessed surface of the surface 12 that defines the entrance guide 10 connects to the inner wall of the ring nut 4 by means of an inclined connecting portion 19.

Moreover, angularly facing the connecting portion 19, a second recess 39 is provided, obtained in the inner wall of the ring nut 4. The second recess 39 defines a surface that is recessed relative to the surface of the inner wall of the ring nut 4 but with smaller depth than the first recess 12.

The second recess 39 extents at equal elevation to the through opening 30. The opening 30 is thus delimited on one side by a contact wall 14 which borders, for a first section 14*a*, with the inner wall of the ring nut 4 and, for a second section 14*b*, with the second recess 39 slightly recessing relative to the inner wall of the ring nut 4. At the second recess 39 is thus outlined a passage 21, shown in detail in FIG. 3*b*.

Not least, the ring nut 4 comprises, at its own free end that faces the side of the electrical contacts 6, a fin 31 projecting in an axial direction as an extension of its own lateral wall.

On the outer surface of the plug connector 1 are obtained two pairs of protrusions 9 flanking each other axially, each protrusion 9*a*,9*b* consisting of a small elongated element that develops in orthogonal direction to the axis A.

Each pair of protrusions 9 comprises a first guiding protrusion 9*a* and a second coupling protrusion 9*b*. The guiding protrusion 9*a* projects farther than the coupling protrusion 9*b* to cooperate in support against the entrance guide 10, which laterally delimits the first recess 12, and the inclined connecting portion 19. Such cooperation serves to obtain a possible and small (for example by 10-20°) automatic rotation of ring nut 4 when coupling connectors 1 and 2 and an appropriate positioning of ring nut 4 at the end of the insertion of plug connector 1 into socket connector 2.

In his way, during the insertion of the plug connector 1 into the socket connector 2, the guiding protrusions 9*a* determine an elastic deformation of the ring nut 4 and in particular of the ring nut portion 4 surrounded by the through opening 30 and by the two lateral recess portions 30*a*. This deformation makes it possible for the coupling protrusion 9*b* to overcome the inclined connecting portion 19 and the portion of inner wall of the ring nut 4 which borders with the opening 30 to position itself inside the through opening 30.

Once it is positioned in the opening 30, the coupling protrusion 9*b* co-operates in abutment against the contact wall 14 in the first section 14*a* at greater depth, determining a stop that cannot be overcome by the mere application of an axial traction force.

On the outer surface of the plug connector 1 is also obtained a second annular nose 26 projecting radially, against which the ring nut 4 abuts when the plug connector 1 is inserted in the socket connector 2.

On the second annular nose 26 of the plug connector 1 is obtained an additional recess 27, shown in FIG. 1, within which is positioned a coupling tooth 33, projecting in radial direction to the height of the outer surface of the second annular nose 26.

Figure 6:
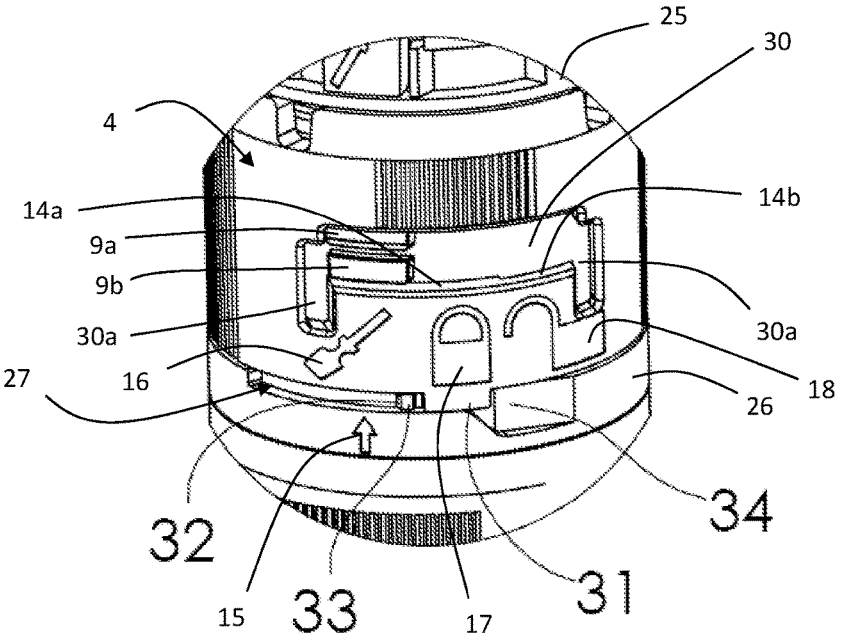
FIG. 6 is a detail of a perspective view of the ring nut in the relative configuration illustrated in FIG. 5*a;*

The coupling tooth 33 is suited for co-operating with the fin 31 projecting axially from the ring nut 4. In particular, as shown in FIG. 6, the coupling tooth 33 comprises at one side an inclined lateral wall 32 that facilitates the passage of the axially projecting fin 31 according to a first angular direction beyond the tooth 33. At the other side, the coupling tooth 33 comprises a wall projecting orthogonally from the outer surface of the plug connector 1 against which the axially projecting fin 31 abuts when it is moved in the opposite angular direction.

To allow the passage of the fin 31 beyond the tooth 33 in the opposite angular direction it is necessary to intervene with a dedicated tool (not shown) to remove radially the fin 31 from the surface of the second annular nose 26 during the passage beyond the tooth 33. For this purpose, the recess 27 obtained in the second annular nose 26 comprises a recess 34 that allows the insertion of the instrument below the fin 31.

Figure 5A:
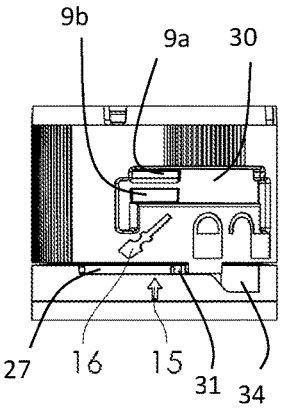
Figure 5B:
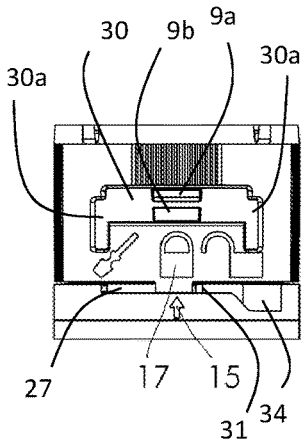
Figure 5C:
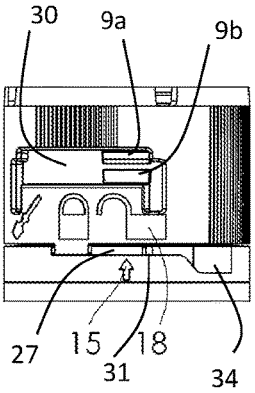

In the illustrated embodiment, the ring nut 4 comprises three symbols 16, 17, 18 provided below the through opening 30 that indicate three relative positions of alignment that the ring nut 4 can assume with respect to the plug connector 1 (each shown in FIGS. 5*a*-5*c*). For this purpose, an arrow-shaped symbol 15 is provided on the body of the plug connector. The alignment of the arrow 15 with each symbol 16, 17, 18 indicates the attainment of each alignment position.

On the bodies of the plug connector 1 and socket connector 2 are respectively present a first 22 and a pair of second 23, 24 annular rings obtained by moulding. On the plug connector 1, the annular gasket 22 is positioned in an axial direction, beyond the second annular abutment nose 26. On the socket connector, a first gasket 23 of the pair of second gaskets is in an axial position whereat is positioned the ring nut 4, being located below the ring nut 4. The second gasket 24 is positioned, in axial direction, beyond the first annular abutment nose 25.

The plug connector 1 and socket connector 2 further comprise protecting guards 28, shown in FIG. 1, which, once assembled, compress the co-moulded gaskets 22,24 positioned beyond the respective annular noses 25,26 with respect to the connection interface between the plug and the socket 2. In particular, when the plug connector 1 and the socket connector 2 are completely wired and assembled with the related protecting guards 28, the annular gaskets 22,24 are compressed by the internal surfaces of the guards 28 determining an effective barrier to the penetration of dusts or liquids.

The plug connector 1 and the socket connector 2 lastly comprise, each in a known manner, an external gasket (not shown) and a nut 29 that are couple to the respective protecting guards 28.

The operation of the linear connection assembly for electrical conductors according to the present invention can be understood from the preceding structural description of the preferred embodiment; nevertheless, the operation is explained below.

During the insertion of the plug connector 1 into the socket connector 2, the guiding protrusions 9*a* co-operate with the corresponding entrance guides 10 which make them slide inside the first recesses 12 towards the inclined connecting surfaces 19.

At this point, applying an increased axial insertion force, the guiding protrusions 9*a* are thrust along the inclined surfaces of the connecting portion 19, determining a temporary elastic deformation of the ring nut portion 4 surrounded by the through opening 30 and by the two lateral recess portions 30*a*.

This deformation makes it possible for the pairs of protrusions 9 to overcome the inclined connecting portion 19 and the portion of inner wall of the ring nut 4 which borders with the opening 30 to position itself inside the through opening 30.

Once the pairs of protrusions 9 overcome the respective inclined surfaces 19 and portions of inner wall of the ring nut 4, the ring nut 4 returns to the original shape. The pairs of protrusions 9 are thus stably housed in the openings 30 at the first alignment position.

In this position, each coupling protrusion 9*b* co-operates in abutment against the first section 14*a* of the contact wall 14 which delimits the respective opening 30, stably holding the coupling protrusions 9*b* against an axial traction force.

In the first alignment position, the positioning arrow 15 is aligned with the first symbol 17 (central) provided on the outer surface of the ring nut 4.

Once the plug connector 1 is inserted, with a purely axial movement, into the socket connector 2 and the ring nut 4 is brought to the first alignment position (such positioning of the ring nut can also be obtained, fully or partly, automatically by effect of the insertion operation and by means of at least one appropriate entrance guide and of at least one appropriate guide protrusion), the ring nut 4 can be rotated manually around its axis A (which coincides with the axes of the connectors 1 and 2) for example until bringing it to the second alignment position, in which the positioning arrow 15 faces the second symbol 18 (to the right of the first symbol 17 in FIG. 6) provided on the outer surface of the ring nut 4, or in the third alignment position, in which the positioning arrow 15 faces the third symbol 16 (to the left of the first symbol 17 in FIG. 6) provided on the outer surface of the ring nut 4.

In this second position, the detachment between the plug connector 1 and the socket connector 2 is allowed by means of a simple manual traction in an axial direction along the axis A because the pairs of protrusions 9 are positioned at the second section 14*b* of the contact wall 14 which defines the passage 21. An axial translation between the plug connector 1 and the socket connector 2 is thus no longer impeded, because the supporting protrusions 9*b* no longer abut against the first section of the contact wall 14, but on the contrary, are positioned at the passage 21 outlined by the second section of said contact wall 14.

Thus to bring the connection assembly 100 from the first connection condition (not releasable by axial traction) in which the arrow 15 is aligned to the symbol 17, to the second connection condition (releasable by axial traction) in which the arrow 15 is aligned to the symbol 18, a voluntary manual action of rotation of the ring nut 4 from the first alignment position to the second alignment position is necessary; this manual rotation action is free, i.e. it is not impeded by any element or mechanism associated to the connector 1 or to the connector 2 or to the ring nut 4.

According to need, it is possible to rotate the ring nut 4 from the first alignment position to the third alignment position, so that the detachment between the plug connector 1 and the socket connector 2 requires the use of a tool. When the ring nut 4 is in the third alignment position, the connection assembly is in a third connection condition which can be called "locked condition"; the connection is not releasable by an axial traction action; moreover, to bring the ring nut 4 from the third alignment position to the second alignment position (in which the connection is releasable by axial traction action), passing through the first alignment position, the action of a tool on the ring nut 4 and/or on one or both connectors 1 and 2 is necessary; in particular, the action of the tool is necessary to pass from the third alignment position to the first alignment position.

According to the embodiment of the figures, the locked condition is obtained because the projecting fin 31 obtained on the ring nut 4 overtakes the inclined lateral wall 32 obtained on the coupling tooth 33. The removal of the locked condition can be carried out with the aid of a tool that can be inserted into the recess 34 which, radially lifting the fin 31, makes it possible to bring it back beyond the coupling tooth 33.

When the projecting fin 31 is brought back beyond the coupling tooth 33, the connection assembly 100 is again in the first connection condition, and therefrom it can be manually brought to the second connection condition by simple rotation of the ring nut 4.

From the preceding description, it is readily understandable why the ring nut 4 can also be called "clamping ring nut".

According to an alternative embodiment (see FIG. 7), the tool is not used to directly determine a small deformation of the ring nut, but is used, as a lever, to cause the rotation of the ring nut from the third alignment position ("locked condition") to the first alignment position; a small deformation of the ring nut is a consequence of the rotation and occurs when the ring nut is in a certain intermediate position between the third position and the first position.

Figure 7:
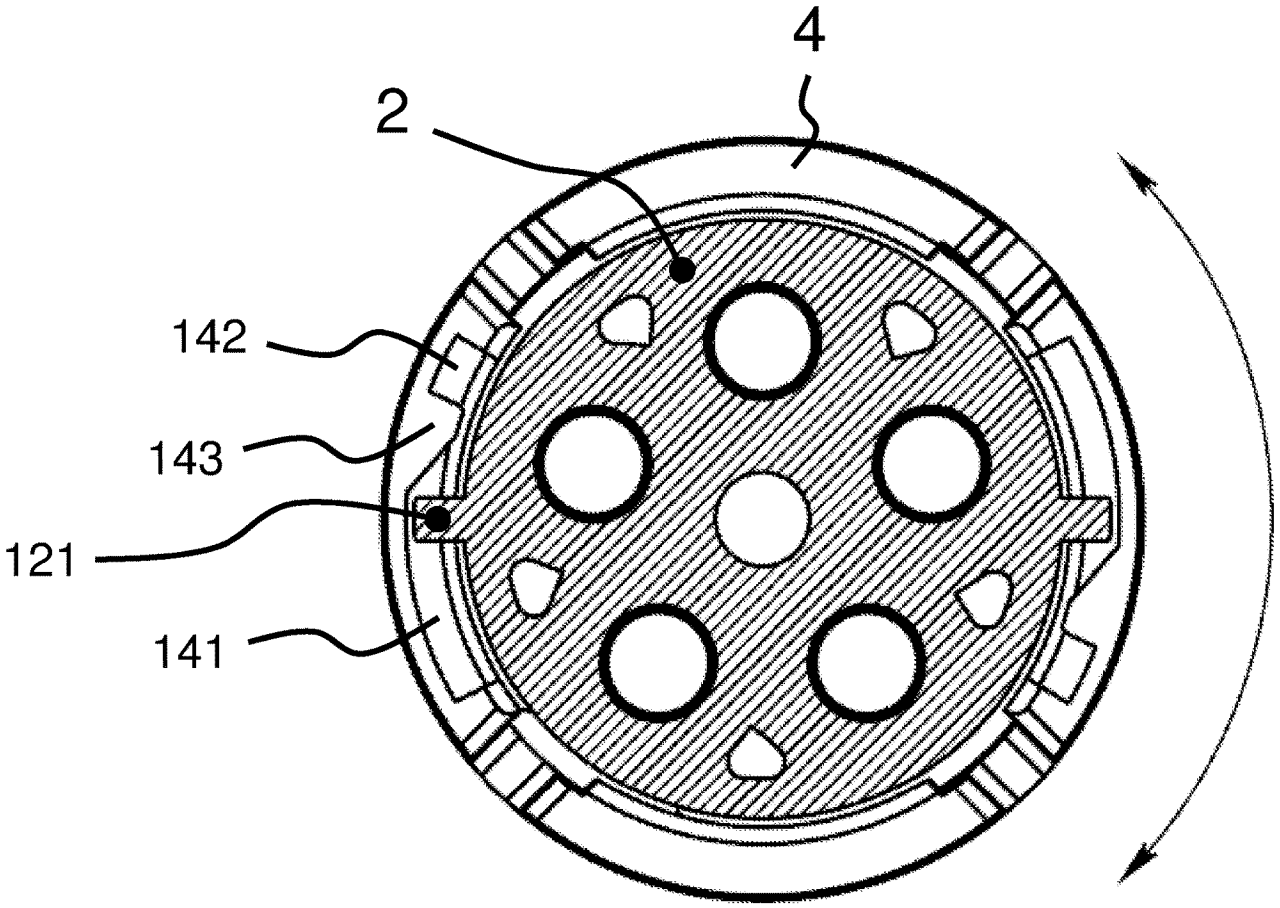
FIG. 7 is a sectioned view of a ring nut e and of a plug connector according to an alternative embodiment.

In FIG. 7, the socket connector 2 is shown in cross section and the ring nut 4 is not sectioned.

The connector 2 has a tooth 121 projecting outwards, i.e. towards the ring nut 4; in diametrically opposite position, there can also be another tooth. The ring nut 4 has two seats 141 and 142 separated by a tooth 143 and adapted to receive the tooth 121 of the connector 2; in diametrically opposite positions, there can also be two other seats and another tooth.

The position shown in FIG. 7 corresponds to the first alignment position, i.e. when the connector 1 is initially inserted into the connector 2. From this first position, the ring nut 4 can be rotated manually without impediment and brought to the second alignment position; the tooth 121 can move freely in the seat 141. From this first position, the ring nut 4 can be rotated and brought also to the third alignment position; in this case, the tooth 121 first thrusts on the inclined wall of the tooth 143 causing a small deformation of the ring nut 4 and then ends in the seat 142; this manual rotation requires a bit of strength.

Once the tooth 121 is in the seat 143, by effect of the shape and of the dimension of the seat 143, the ring nut 4 cannot be rotate manually and brought back to the first alignment position. To obtain this rotation, a tool is used, e.g. the metal rod of a screwdriver, that is inserted into a through hole (not shown in the figure) of the ring nut 4 and that is inserted in a seat (not shown in the figure) of the connector 2; the direction of insertion can for example be radial. Leveraging the connector 2, the tool (operating manually) can thrust the ring nut 4 acting on the edge of the through opening and make it rotate causing a small deformation thereof, caused by the tooth 143 that acts on the tooth 121.

From the above description the features of the linear connection assembly for electrical conductors of the present invention, as well as the advantages thereof, are readily apparent.

From the embodiments described above, additional variants are possible, without thereby departing from the teaching of the invention.

Lastly, it is clear that a linear connection assembly for electrical conductors thus conceived is susceptible to many modifications and variations, without departing from the scope of the invention; furthermore, all details can be replaced by technically equivalent elements. In practice, the materials used, as well as their dimensions, can be of any type according to the technical requirements.

The invention claimed is:

1. A linear connection assembly for electrical conductors comprising a pair of connectors with mutually complementary shapes for the insertion of a first connector into a second connector in an axial direction; each connector being provided with electrical contacts adapted to electrically connect to each other when the first connector is inserted in the second connector, at least one connector of the pair of connectors being provided with a ring nut mounted in at least partially rotatable manner manually around its axis parallel to said axial direction to reach a plurality of alignment positions relative to the other connector of the pair of connectors, each alignment position corresponding to a connection condition between the pair of connectors, wherein a first alignment position results from a complete insertion of said first connector into said second connector, and corresponds to a first connection condition according to which said connectors cannot be released even if a mutual traction is applied in the axial direction; wherein a third alignment position results from a manual rotation of said ring nut in a second direction starting from said first position of alignment, and corresponds to a third connection condition according to which said connectors cannot be released even if a mutual traction is applied in the axial direction, wherein a manual rotation of said ring nut from said third alignment position to said first alignment position is possible only if combined with an action of a tool on said ring nut and/or on a connector of the pair of connectors.

2. The linear connection assembly according to claim 1, wherein a second alignment position results from a manual rotation of said ring nut in a first direction starting from said first alignment position, and corresponds to a second connection condition according to which said connectors are released if a mutual traction is applied in the axial direction.

3. The linear connection assembly according to claim 1, characterised in that a connector of the pair of connectors is provided with said ring nut and that the other connector of the pair of connectors comprises at least one tooth projecting from the body of the connector in a radial direction, the tooth being adapted to co-operate with a fin projecting from the ring nut in an axial direction in order to block the rotation of the ring nut in at least one direction of rotation.

4. The linear connection assembly according to claim 3, wherein the tooth is made within a recess obtained on the body of the other connector at an abutment portion the ring nut when the first connector is inserted in the second connector.

5. The linear connection assembly according to claim 4, wherein the recess obtained on the body of the other connector comprises a recess portion adapted to allow the insertion of a tool beneath the fin when the fin is in a condition in which the tooth blocks the rotation thereof according to the angular direction opposite the first one.

6. The linear connection assembly according to claim 3, wherein the tooth comprises, on one side, a side wall projecting from the body of the other connector in an inclined manner to facilitate the passage of the fin according to a first angular direction and, on the other side, a wall projecting orthogonally from the body of the other connector to block the passage of the fin according to an angular direction opposite the first one.

7. The linear connection assembly according to claim 3, wherein the other connector of the pair of connectors comprises at least one protrusion adapted to cooperate with a respective entrance guide made in the inner wall of the ring nut in order to reach a respective opening, with development orthogonal to the axis, also made in the inner wall of the ring nut, each opening being delimited on a side orthogonal to the axis by a contact wall adapted, at a first section, to determine a stop abutment for the at least one protrusion.

8. The linear connection assembly according to claim 7, wherein the contact wall comprises a second section defining an axial passage for the at least one protrusion.

9. The linear connection assembly according to claim 7, wherein the other connector of the pair of connectors comprises a pair of protrusions comprising a first guide protrusion and a second coupling protrusion, the guide protrusion being more prominent than the coupling protrusion in order to co-operate in abutment against the entrance guide and the coupling protrusion being adapted to cooperate in abutment against the first section of the contact wall.

10. The linear connection assembly according to claim 7, wherein the opening made in the inner wall of the ring nut is of the through type and delimited by a notch with substantially axial development at least at one side end.

11. The linear connection assembly according to claim 7, wherein the entrance guide is obtained as a first recess in the inner wall of the ring nut which extends substantially between a free end of the ring nut and the respective opening, the first recess being connected to the first section of the contact wall of the opening by means of an inclined connecting surface.

12. The linear connection assembly according to claim 1, wherein at least one sealing ring obtained by means of a moulding operation is present on the body of at least one connector of the pair of connectors.

* * * * *